US006457297B1

(12) United States Patent
Trani et al.

(10) Patent No.: US 6,457,297 B1
(45) Date of Patent: Oct. 1, 2002

(54) METHOD FOR MANUFACTURING POUCH LIKE CONTAINER

(75) Inventors: Giorgio Trani; Marion Sterner, both of Venice (IT)

(73) Assignee: BP Europak, S.p.A. (IT)

( * ) Notice: Subject to any disclaimer, the term of this patent is extended or adjusted under 35 U.S.C. 154(b) by 0 days.

(21) Appl. No.: 09/678,007

(22) Filed: Oct. 3, 2000

(30) Foreign Application Priority Data

Oct. 5, 1999 (IT) ..... PD99A0218

(51) Int. Cl.[7] ..... B65B 3/02

(52) U.S. Cl. ..... 53/452; 53/433; 53/439; 53/451

(58) Field of Search ..... 53/452, 439, 433, 53/467, 469, 477, 567, 562, 451; 383/105

(56) References Cited

U.S. PATENT DOCUMENTS

| | | | | |
|---|---|---|---|---|
| 3,082,585 A | * | 3/1963 | Waters | |
| 4,125,985 A | * | 11/1978 | Laske | 53/452 |
| 4,648,506 A | * | 3/1987 | Campbell | |
| 5,080,747 A | * | 1/1992 | Veix | |
| 5,682,726 A | * | 11/1997 | Green et al. | 53/433 |
| 5,735,107 A | * | 4/1998 | Vollenweider et al. | 53/451 |

FOREIGN PATENT DOCUMENTS

| | | |
|---|---|---|
| FR | 2 671 052 | 7/1992 |
| FR | 2 759 981 | 8/1998 |
| GB | 1 115 636 | 5/1968 |
| WO | 98 18674 | 5/1998 |

* cited by examiner

*Primary Examiner*—Eugene Kim
*Assistant Examiner*—Sameh Tawfik
(74) *Attorney, Agent, or Firm*—Finnegan, Henderson, Farabow, Garrett & Dunner L.L.P.

(57) ABSTRACT

A pouch-like container with faces made of materials having different consistencies and/or characteristics, particularly for solid, granular or fluid products. Conveniently, one of the two faces is produced from a scarcely flexible sheet, while the other face is produced from a much lighter and preferably transparent sheet in order to show the contained product. The low-flexibility face has ribs to preset a deformability and set the final shape that the container will assume. The container is manufactured by coupling, along longitudinal lines (lateral borders) and transverse lines, two sheets which are unwound continuously from two rolls. The tougher sheet is pre-ribbed along lines which force a controlled deformation, forming the container when it is filled with the product.

4 Claims, 4 Drawing Sheets

METHOD FOR MANUFACTURING POUCH LIKE CONTAINER

CROSS-REFERENCE TO RELATED APPLICATIONS

This application claims priority to Italian Application No. PD99000218 filed Oct. 5, 1999, the disclosure of which is incorporated herein by reference.

BACKGROUND OF THE INVENTION

The present invention relates to a pouch-like container with faces made of materials having different consistencies and/or characteristics and to a method for manufacturing it.

According to the state of the art, pouch-shaped containers are manufactured by coupling two sheets of a flexible material which is usually relatively rigid in order to give consistency to the resulting container.

These pouch-like containers usually do not have an aesthetically valid appearance, and the use of materials which both have considerable strength does not allow, for example, to show and/or display the contained product unless very expensive raw materials are used.

According to other technologies, sachets are formed by using lightweight materials in sheet form, but such sachets do not have a shape of their own and are poorly suited for the containment of many kinds of product.

SUMMARY OF THE INVENTION

The aim of the present invention is to provide a container which has a shape of its own and is relatively strong.

A further object is to provide a pouch-like container having two faces which have different functions.

Another object is to provide a container which assumes a shape of its own during filling with the product.

Another object is to provide a container which can be obtained easily by means of conventional packaging machines.

Another object is to obtain an already-filled container with a single operation on a single machine.

Still another object is to replace a composite package, constituted by parts which give and maintain a shape and parts that contain and preserve the product, with a single container which performs the same functions.

These and other objects which will become better apparent hereinafter are achieved by a pouch-like container with faces made of material having different consistencies and/or characteristics, characterized in that it consists of a pouch obtained by heat-sealing two sheets of flexible material along a predefined contour, a first sheet being constituted by a tough and solid material and a second sheet being constituted by a lightweight and preferably transparent material.

Conveniently, the tougher sheet has ribs along lines which determine, with the deformation produced by filling, the shape of the container to be obtained.

The present invention also relates to the method for obtaining the container, which is characterized by the following operating steps:

a) preparing a roll of relatively heavy and tough material for constituting a first sheet, with uniformly spaced ribs;

b) coupling, with a packaging machine, said first sheet to a second sheet of a much lighter flexible material along two longitudinal lateral lines, with reference to the advancement direction in the packaging machine, and a transverse base line;

c) filling the open pouch with the product to be contained, optionally deforming, with auxiliary means, the heavier sheet along the ribs;

d) closing the filling mouth by heat-sealing.

BRIEF DESCRIPTION OF THE DRAWINGS

Further characteristics and advantages of the invention will become better apparent from the detailed description of a preferred embodiment thereof, illustrated only by way of non-limitative example in the accompanying drawings, wherein.

DESCRIPTION OF THE PREFERRED EMBODIMENTS

Figure 1:
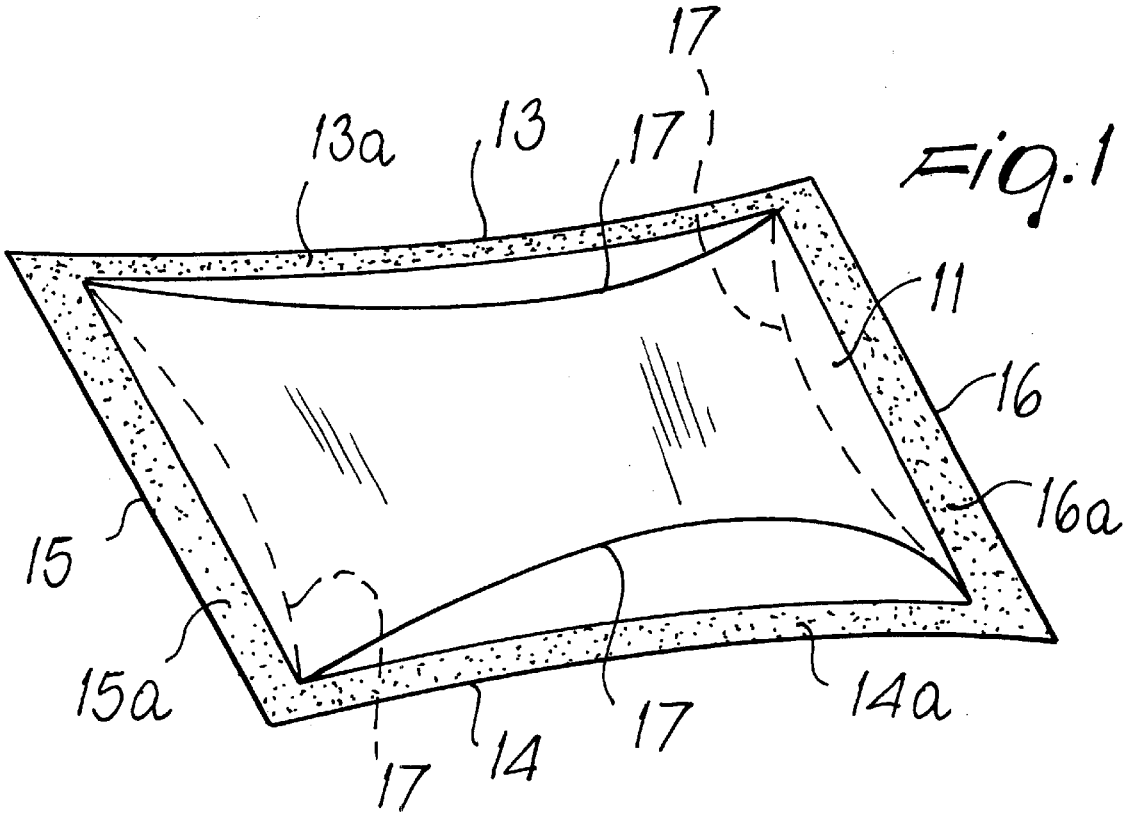
FIG. 1 is a view of the first face of the pouch, obtained with a relatively tough material.

With reference to the figures, the container according to the invention is substantially a pouch 10 obtained by means of two sheets of flexible material, designated by the reference numerals 11 and 12.

The sheet 11 is made of a material which is flexible but tough and solid.

Such sheet 11 has, in the configuration illustrated in the figures, by way of example, a substantially rectangular shape with two long sides 13 and 14 which correspond to the line of advancement direction in the packaging machine, which will be illustrated schematically hereinafter.

Such sheet has two shorter transverse sides 15 and 16 which correspond to lines that lie transversely to the advancement direction in the packaging machine.

At the four sides 13, 14, 15 and 16 bands are provided, designated by the reference numerals 13*a*, 14*a*, 15*a* and 16*a* respectively, where a heat-activated product is placed during an operation for preparing said sheet and which will allow the coupling of the second sheet 12.

Figure 2:
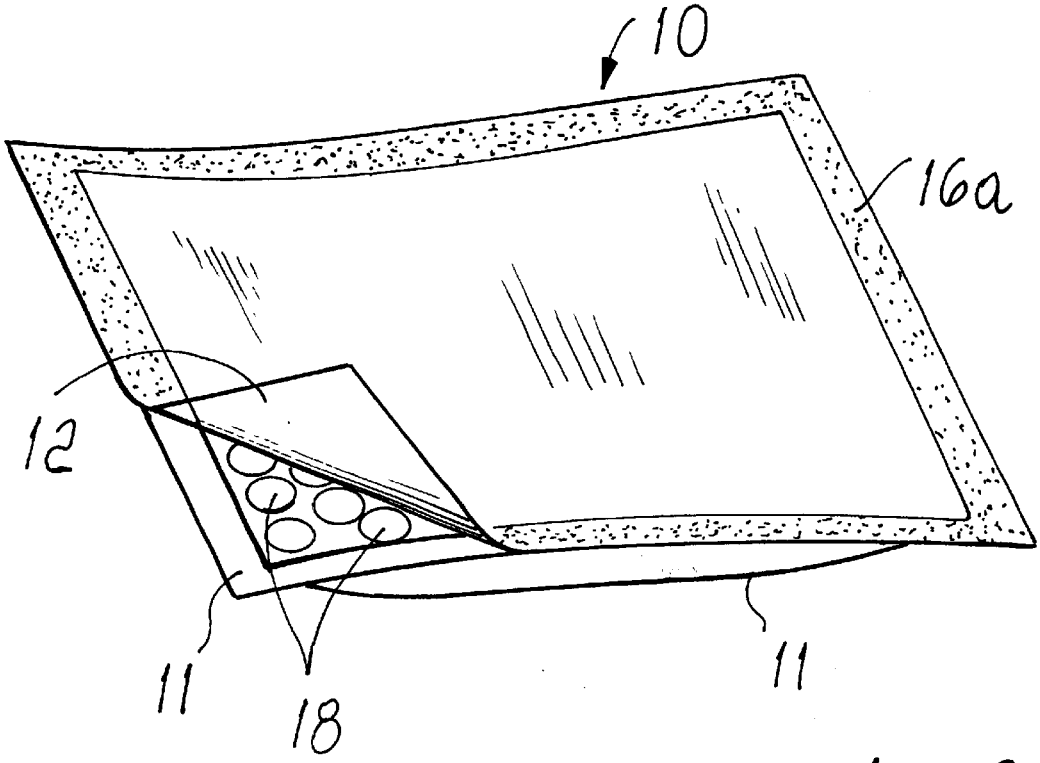
FIG. 2 is a view of the container once it has been filled and closed.

Ribs 17 are provided on said first sheet 11; when the product to be contained, designated by the reference numeral 18 in FIG. 2, is introduced in the container, such ribs determine the camber of the sheet 11 and therefore the shape, which in the case can be likened to a tray or other container, that the container 10 assumes.

Preferably, in order to show the contained product, the sheet 12 is made of a very light and transparent material.

Figure 3:
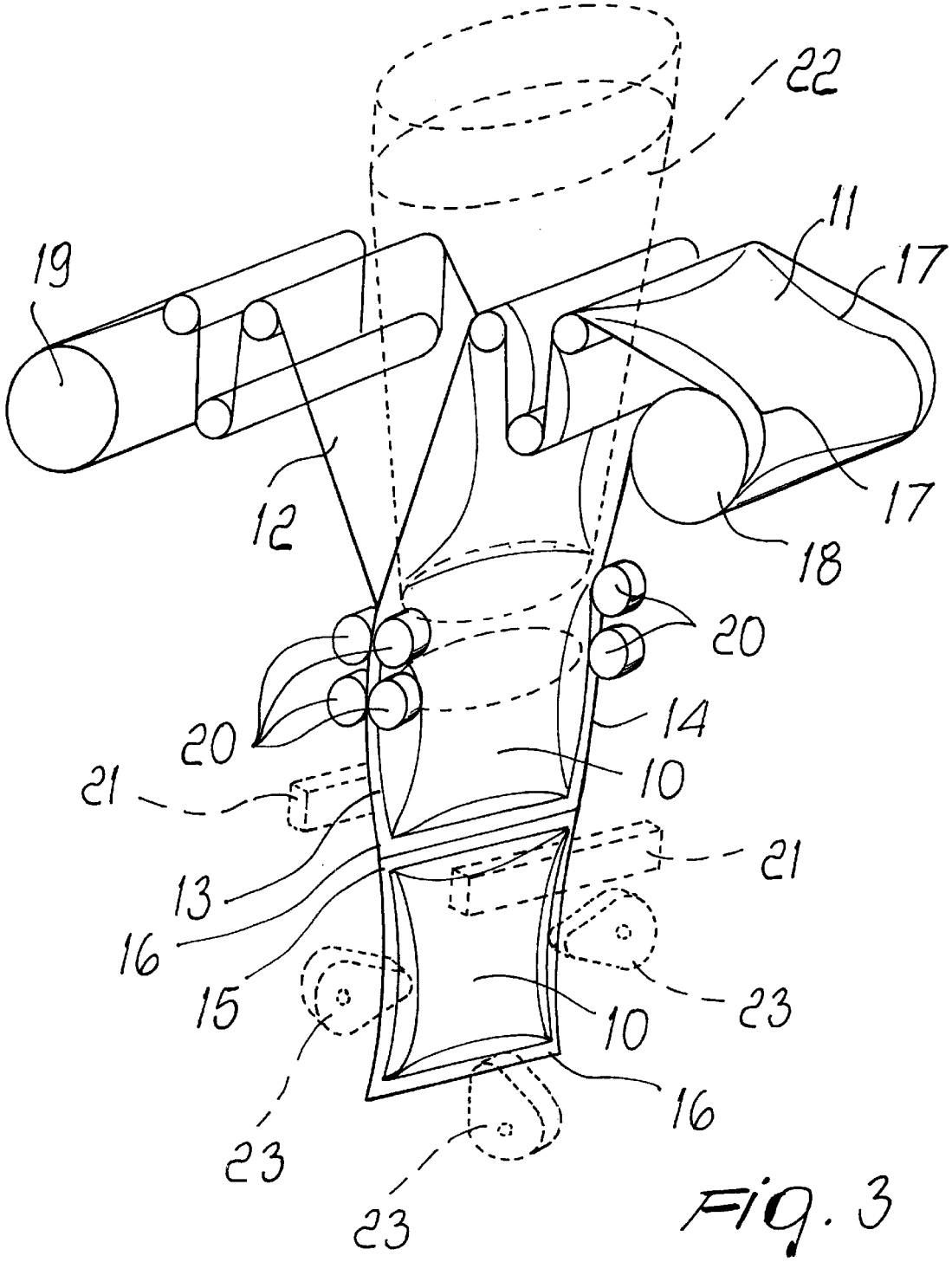
FIG. 3 is a schematic view showing the manufacture and filling of the container.
Figure 4:
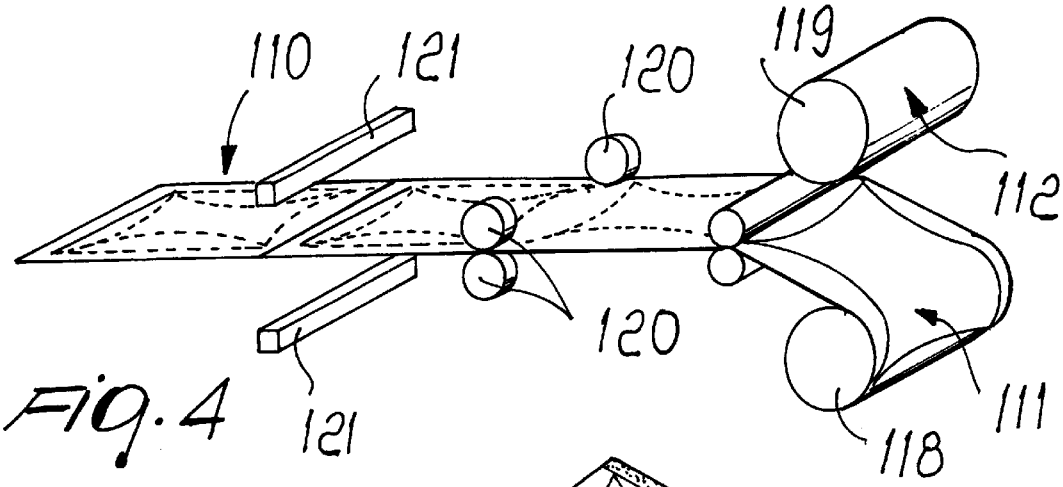
FIG. 4 is a view showing the preparation of individual pouches with an open side.

FIG. 3 illustrates a continuous manufacturing line and shows a roll 18 constituted by an unbroken succession of sheets 11 on which an operation has already been performed beforehand in order to obtain the ribs 17.

The line furthermore has a second roll 19 which is constituted by the flexible and transparent material that will constitute the second sheet 12 with which the container is manufactured.

The same figure schematically illustrates the rollers 20 which heat-seal the longitudinal edges 13 and 14 and the bars 21 that heat-seal the transverse lines 15 and 16.

The container 10 is filled by way of a product feeding cone 22, while eccentric means 23 are optionally provided, preferably after closing the container 10; by pressing on the sides of the container 10, said eccentric means cause the deformation of the sheet 11 along the ribs 17.

The result is a container which is substantially shaped like a tray, with a very sturdy resting base and a transparent upper face which shows the contained product, and in which the formation and filling of the container occur in a single operating sequence on a single machine.

As an alternative to continuous linear manufacturing, FIGS. 4, 5, 6 and 7 illustrate discontinuous manufacturing, whereby the pouch-like container, now designated by the reference numeral 110, is again obtained from the coupling of a tough and pre-ribbed sheet 111 and of a lightweight transparent sheet 112, which are contained in rolls 118 and 119.

In this case also, heated rollers 120 produce two longitudinal heat-seals, while transverse bars 121 produce a transverse heat-seal which leaves open a mouth of the pouch.

Figure 5:
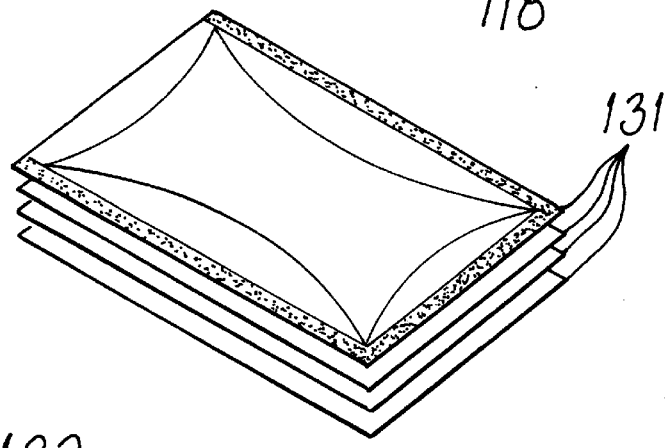
FIG. 5 is a view showing the stacking of individual empty pouches.

The pouches, as shown in FIG. 5, where they are designated by the reference numeral 131, can be stacked and stored up to the time of use.

Figure 6:
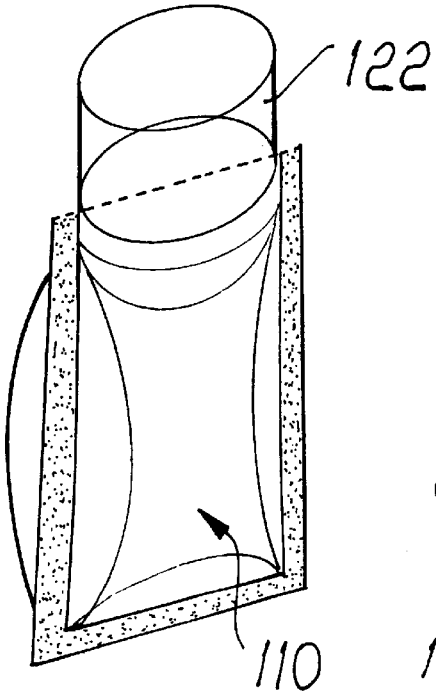
FIG. 6 is a view showing the filling of a single pouch, forming the container.

FIG. 6 schematically illustrates the filling of the pouch 110, which occurs by means of an apparatus of which only the filling funnel 122 is shown.

Figure 7:
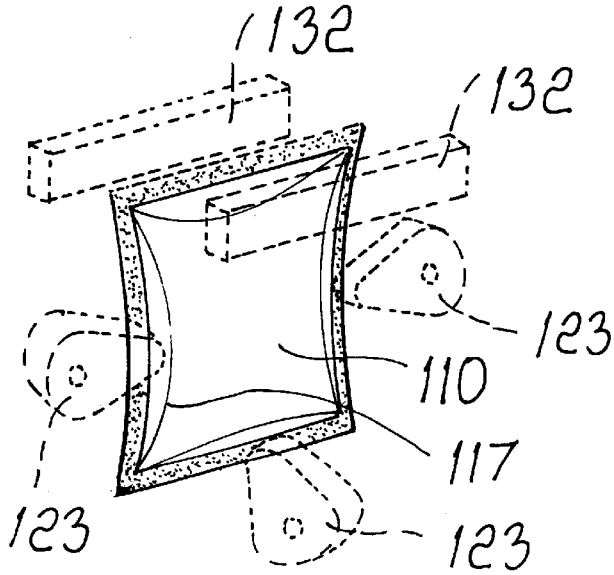
FIG. 7 is a view showing the closure of the individual pouch and the use of optional auxiliary means for correctly forming the container.
Figure 8:
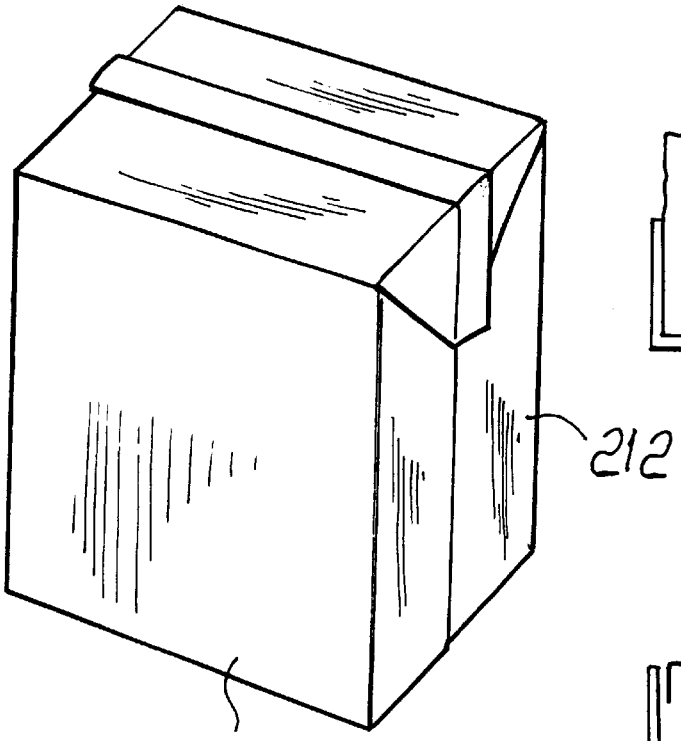
FIGS. 8 to 12 are alternative but technically equivalent embodiments of the container.
Figure 9:
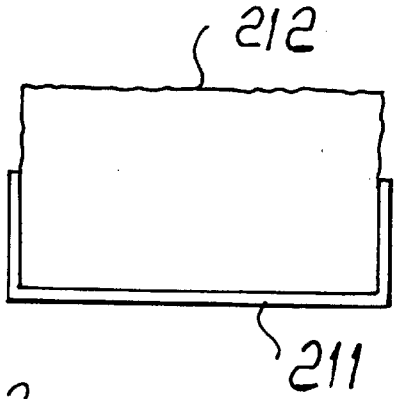
Figure 10:
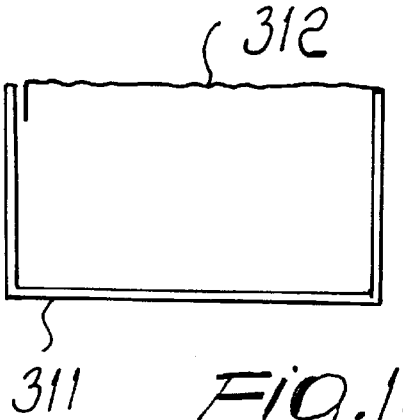
Figure 11:
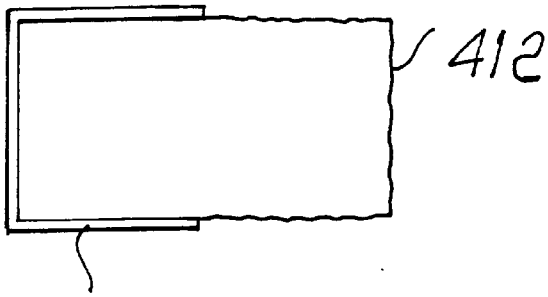
Figure 12:
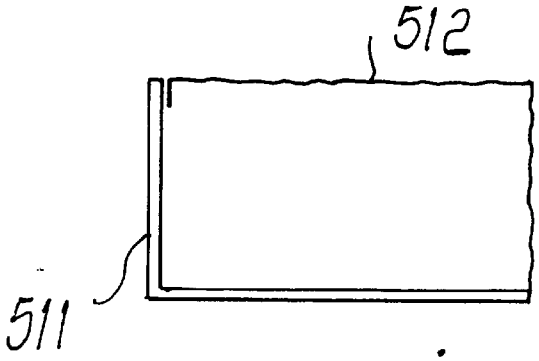

In this case also, as shown in FIG. 7, the mouth of the pouch 110 is closed subsequently by means of two heat-sealing bars, now designated by the reference numeral 132, and in this case also there are formation means 123, albeit optional ones, for forming the container by utilizing the presence of the ribs 117.

By analogy to what has been described above, the container, which has been described throughout as pouch-like, can also be shaped like a parallelepiped, as shown in FIGS. 8, 9, 10, 11 and 12.

Again, there is a part obtained from a tough sheet 211, 311, 411 and 511, while some parts, designated by the reference numerals 212, 312, 412 and 512, are made of lightweight and transparent material.

From the above description and the illustrations it is evident that the present solution achieves the aim and the intended objects and that the container obtained is extremely advantageous.

The adoption of a tough semirigid sheet which in any case has a good consistency and is capable of assuming a predefined shape allows to obtain a container which always has the same shape and can be efficiently contained in turn in large numbers inside storage boxes and can still be placed on a display for sale.

The tough sheet can be made of a low-value material having only good mechanical and stability characteristics.

Conveniently, the thin sheet is transparent, so that the product can be displayed in an optimum manner; said sheet, made of a higher-value material, is also well-suited to be printed with lettering, designs and trademarks such as to identify the manufacturer and illustrate the characteristics of the product.

The container has been termed "pouch-like", but this is done merely to define the fact that it is formed by means of just two sheets.

The dimensions and the materials may of course be any according to requirements.

The disclosures in Italian Patent Application No. PD99A000218 from which this application claims priority are incorporated herein by reference.

What is claimed is:

1. A method for manufacturing a pouch like container with faces made of materials having different characteristics, the pouch like container comprising a first sheet comprising a tough and solid, yet flexible, material; and a second sheet comprising a lightweight flexible material; said first and second sheets being heat-sealed along a predefined contour line so as to form a pouch; the method comprising the following operating steps performed on a same machine:

preparing a roll of relatively heavy and tough material for constituting a first sheet, with uniformly spaced ribs thereof, the ribs being drawn on the first sheet and defining a chamber of the container;

coupling, with a packaging machine, said first sheet to a second sheet of a much lighter flexible material along two longitudinal lateral lines and a transverse base line, as referred to an advancement direction of the machine;

filling the container with product to be contained, and optionally deforming, with auxiliary deformation means, the first sheet along said ribs; and closing, by heat-sealing, an open part of the container used for filling.

2. The method of claim 1, performed on continuous packaging machines.

3. The method of claim 2, performed by producing individual containers in the form of pouches, to be filled subsequently.

4. The method of claim 1 wherein the second sheet comprises a transparent material.

* * * * *